US010500460B2

(12) United States Patent
Ali et al.

(10) Patent No.: US 10,500,460 B2
(45) Date of Patent: Dec. 10, 2019

(54) COLLAPSIBLE NET ASSEMBLY

(71) Applicant: Terra Sports LLC, Millersville, PA (US)

(72) Inventors: Walter Ali, Lancaster, PA (US); Christian Kelker, Millersville, PA (US); Ken Eckert, Millersville, PA (US); Andy Zook, Millersville, PA (US)

(73) Assignee: Terra Sports LLC, Millersville, PA (US)

( * ) Notice: Subject to any disclaimer, the term of this patent is extended or adjusted under 35 U.S.C. 154(b) by 0 days.

(21) Appl. No.: 15/764,044

(22) PCT Filed: Sep. 27, 2016

(86) PCT No.: PCT/US2016/053886
§ 371 (c)(1),
(2) Date: Mar. 28, 2018

(87) PCT Pub. No.: WO2017/058749
PCT Pub. Date: Apr. 6, 2017

(65) Prior Publication Data

US 2018/0290035 A1 Oct. 11, 2018

Related U.S. Application Data

(60) Provisional application No. 62/234,245, filed on Sep. 29, 2015.

(51) Int. Cl.

| | |
|---|---|
| ***A63B 63/00*** | (2006.01) |
| ***A63B 71/00*** | (2006.01) |
| ***A63B 71/02*** | (2006.01) |
| *A63B 102/32* | (2015.01) |
| *A63B 102/18* | (2015.01) |

(52) U.S. Cl.
CPC ..... *A63B 63/00* (2013.01); *A63B 71/0036* (2013.01); *A63B 71/023* (2013.01); *A63B 2102/18* (2015.10); *A63B 2102/182* (2015.10); *A63B 2102/32* (2015.10);
(Continued)

(58) Field of Classification Search
CPC ..... A63B 2210/50; A63B 2210/58; A63B 63/004; A63B 63/00
USPC ..... 273/398–402, 395, 396; 473/197, 473/476–478, 421, 456, 454
See application file for complete search history.

(56) References Cited

U.S. PATENT DOCUMENTS 2,074,125 A 3/1937 Lefft et al.
2,827,297 A * 3/1958 Foster ..... A63B 63/00 217/15
(Continued)

*Primary Examiner* — Mark S Graham
(74) *Attorney, Agent, or Firm* — The Webb Law Firm

(57) ABSTRACT

A collapsible catch assembly includes a box having a front wall, a rear wall, a left sidewall, a right sidewall, a bottom wall, and a lid collectively defining a hollow interior, wherein the lid is movable between an open position for allowing access to the hollow interior and a closed position for limiting access to the hollow interior; at least two support poles pivotably mounted within the hollow interior of the box; and a catch device supported on and extending between the at least two support poles. The at least two support poles and the catch device are collapsible to fit within the hollow interior of the box and extensible to extend out of the hollow interior of the box and define a catch area extending upwardly from the box.

26 Claims, 20 Drawing Sheets

(52) U.S. Cl.
CPC ..... *A63B 2210/50* (2013.01); *A63B 2210/54* (2013.01); *A63B 2225/093* (2013.01)

(56) References Cited

U.S. PATENT DOCUMENTS

| | | | | | |
|---|---|---|---|---|---|
| 3,981,501 | A | | 9/1976 | Gonzalez et al. | |
| 4,133,531 | A | * | 1/1979 | Arteaga | A63B 69/0097 273/395 |
| 4,135,716 | A | * | 1/1979 | Ginsburg | A63B 61/04 473/416 |
| 4,993,719 | A | | 2/1991 | Hernandez | |
| 5,407,210 | A | * | 4/1995 | Canning | A63B 69/0097 273/348 |
| 5,421,586 | A | * | 6/1995 | Amram | A63B 63/004 273/127 B |
| 5,690,339 | A | * | 11/1997 | Chen | A63B 63/004 273/400 |
| 5,722,905 | A | * | 3/1998 | Bidelman | A63B 71/022 273/400 |
| 7,351,168 | B1 | * | 4/2008 | Pannell | A63B 63/004 273/400 |
| 7,942,419 | B2 | * | 5/2011 | Gelzinis | A63B 67/06 273/396 |
| 9,738,426 | B1 | * | 8/2017 | Giraud | B65D 50/02 |
| 9,795,857 | B2 | * | 10/2017 | Nelson | A63B 71/022 |
| 2007/0191148 | A1 | * | 8/2007 | Shannon | A63B 63/083 473/476 |
| 2016/0287963 | A1 | * | 10/2016 | Mosher | A63B 69/0002 |

* cited by examiner

COLLAPSIBLE NET ASSEMBLY

CROSS REFERENCE TO RELATED APPLICATIONS

The present application claims priority from U.S. Provisional Patent Application No. 62/234,245, filed on Sep. 29, 2015, which is incorporated herein by reference in its entirety.

BACKGROUND OF THE INVENTION

Field of the Invention

The present invention relates generally to a net assembly for raising and supporting a net for use in playing or practicing sports. In particular, the present invention relates to a collapsible net assembly that can be placed within a ground surface and which can move a sports net between a stored condition within the assembly and a deployed condition, wherein the net defines a catch area.

Description of Related Art

Presently, sports nets are provided, wherein the net is supported by a permanent structure, from which the net may be removed for storage or replacement, or by a movable structure, which may be removed for storage. Permanent structures disrupt the use of the area where the net is installed for other purposes, such as other sports or non-sports activities. Further, permanent structures must be maintained due to exposure to environmental conditions. Movable sports net structures tend to be bulky and difficult to move and set up. Further, the movable net structures must be transported from the field or area to a storage location and vice versa. The storage location may have limited space available or may be located far away from the field or area.

SUMMARY OF THE INVENTION

Generally provided is a net support structure that allows for quick, efficient, and safe storage and deployment of the net structure, and that protects the net and supports the net from environmental conditions.

According to one embodiment or aspect of the present disclosure, provided is a collapsible net assembly that includes a box that holds and stores a sports net underground. When the box is opened, the net can be deployed. The net and the net support structure can also be folded back down into the box for storage and safety underground. Preferably, provided is an assembly that allows for the net to be set up and put away in under a minute. Preferably, provided is an assembly that allows for the net to last longer because the net can be placed in a closed container when not in use, thereby limiting damage to the net from environmental conditions, such as moisture and sunlight. Preferably, the box can be partially buried in a ground surface so that the box can remain in a location without disrupting other uses of the area and without requiring use of storage space or transport for storage. Preferably, the box is water resistant so that, when the lid is closed, the box can be buried in a ground surface and left outside while protecting the net from environmental conditions. Preferably, once the lid is open, poles for supporting the net can be pulled up and extended to expose a full sports net for multiple sports uses. When finished using the net, the poles can be collapsed and the net can be folded into the box again.

In accordance with one preferred and non-limiting embodiment or aspect of the present disclosure, a collapsible catch assembly is provided. The collapsible catch assembly includes a box having a front wall, a rear wall, a left sidewall, a right sidewall, a bottom wall, and a lid collectively defining a hollow interior, wherein the lid is movable between an open position for allowing access to the hollow interior and a closed position for limiting access to the hollow interior; at least two support poles pivotably mounted within the hollow interior of the box, the at least two support poles being pivotable between a folded position disposed within the hollow interior of the box and a raised position extending from the hollow interior of the box; and a catch device supported on and extending between the at least two support poles. The at least two support poles and the catch device are collapsible to fit within the hollow interior of the box and extensible to extend out of the hollow interior of the box and define a catch area extending upwardly from the box.

In accordance with another preferred and non-limiting embodiment or aspect of the present disclosure, a method of deploying a collapsible catch device is provided. The method includes providing the collapsible catch assembly described in reference to the preceding preferred and non-limiting embodiment or aspect; disposing the collapsible catch assembly in a ground surface; moving the lid to the open position; pivoting the at least two support poles from the folded position to the raised position; and extending the at least two support poles from a collapsed position to an extended position to deploy the catch device to define the catch area.

Further, preferred and non-limiting embodiment or aspects will now be described in the following number clauses.

Clause 1: A collapsible catch assembly comprising: a box comprising a front wall, a rear wall, a left sidewall, a right sidewall, a bottom wall, and a lid collectively defining a hollow interior, wherein the lid is movable between an open position for allowing access to the hollow interior and a closed position for limiting access to the hollow interior; at least two support poles pivotably mounted within the hollow interior of the box, the at least two support poles being pivotable between a folded position disposed within the hollow interior of the box and a raised position extending from the hollow interior of the box; and a catch device supported on and extending between the at least two support poles, wherein the at least two support poles and the catch device are collapsible to fit within the hollow interior of the box and extensible to extend out of the hollow interior of the box and define a catch area extending upwardly from the box.

Clause 2: The collapsible catch assembly according to clause 1, wherein each of the at least two support poles comprises an outer section and an inner section at least partially disposed within the outer section, the outer section being slidably disposed on the inner section in a telescoping arrangement between a collapsed position and an extended position such that a length of the support pole is adjustable.

Clause 3: The collapsible catch assembly according to clause 2, wherein each of the at least two support poles comprises a retaining pin configured to retain the outer section in the extended position.

Clause 4: The collapsible catch assembly according to any one of clauses 1-3, further comprising at least two bracket assemblies, each bracket assembly being configured to pivotably mount a respective one of the at least two support poles in the hollow interior of the box.

Clause 5: The collapsible catch assembly according to clause 4, wherein each bracket assembly comprises: a front bracket mounted on an interior of the front wall of the box; a rear bracket mounted on an interior of the rear wall of the box; and an upper pin and a lower pin extending between the front bracket and the rear bracket and through a respective one of the at least two support poles, and wherein each of the front bracket and the rear bracket includes an upper slot and a lower slot defined therein, the upper pin is slidably disposed in the upper slots of the front bracket and the rear bracket, and the lower pin is pivotably and slidably disposed in the lower slots of the front bracket and the rear bracket.

Clause 6: The collapsible catch assembly according to clause 5, wherein the upper slot of each of the front bracket and the rear bracket has an arcuate shape ending in a notch, the lower slot of each of the front bracket and the rear bracket has an oblong circular shape, and the notch of the upper slot of each of the front bracket and the rear bracket is configured to engage the upper pin to retain the respective support pole in the raised position.

Clause 7: The collapsible catch assembly according to clause 6, wherein the upper slots of the front bracket and the rear bracket are aligned and the lower slots of the front bracket and the rear bracket are aligned.

Clause 8: The collapsible catch assembly according to clause 4, wherein each bracket assembly comprises: a front bracket set mounted on an interior of the front wall of the box, the front bracket set comprising an inner bracket nested within an outer bracket; a rear bracket set mounted on an interior of the rear wall of the box, the rear bracket set comprising an inner bracket nested within an outer bracket; and an upper pin and a lower pin extending between the front bracket set and the rear bracket set and through a respective one of the at least two support poles, and wherein each of the inner bracket and the outer bracket of the front bracket set and each of the inner bracket and the outer bracket of the rear bracket set includes an upper slot and a lower slot defined therein, the upper pin is slidably disposed in the upper slots of the front bracket set and the rear bracket set, and the lower pin is pivotably and slidably disposed in the lower slots of the front bracket set and the rear bracket set.

Clause 9: The collapsible catch assembly according to clause 8, wherein the upper slot of each of the inner and outer brackets of the front bracket set and each of the inner and outer brackets of the rear bracket set has an arcuate shape ending in a notch, the lower slot of each of the inner and outer brackets of the front bracket set and each of the inner and outer brackets of the rear bracket set has an oblong circular shape, and the notch of the upper slot of each of the inner and outer brackets of the front bracket set and each of the inner and outer brackets of the rear bracket set is configured to engage the upper pin to retain the respective support pole in the raised position.

Clause 10: The collapsible catch assembly according to clause 9, wherein the upper slots of the inner and outer brackets of the front bracket set are aligned and the lower slots of the inner and outer brackets of the rear bracket set are aligned.

Clause 11: The collapsible catch assembly according to clause 10, wherein the upper slots of the front bracket set and the rear bracket set are aligned and the lower slots of the front bracket set and the rear bracket set are aligned.

Clause 12: The collapsible catch assembly according to clause 4, wherein the at least two bracket assemblies are vertically spaced with respect to each other such that the at least two support poles are vertically stacked within the hollow interior of the box in the folded position.

Clause 13: The collapsible catch assembly according to any one of clauses 1-12, wherein the catch device comprises a net.

Clause 14: The collapsible catch assembly according to any one of clauses 1-12, wherein the catch device comprises a fabric screen.

Clause 15: The collapsible catch assembly according to any one of clauses 1-14, wherein the catch device comprises sleeves configured to be placed over the at least two support poles to connect the catch device to the at least two support poles.

Clause 16: The collapsible catch assembly according to any one of clauses 1-15, further comprising at least one latch disposed on the lid and at least one flange disposed on an interior of the front wall of the box, wherein the at least one latch is configured to engage the at least one flange to retain the lid in the closed position.

Clause 17: The collapsible catch assembly according to any one clauses 1-16, wherein the box comprises a rim extending around a top of the right sidewall, a top of the front wall, and a top of the left sidewall and a sealing member disposed on the rim, and wherein the sealing member is configured to be engaged by the lid when the lid is in the closed position to seal the hollow interior of the box.

Clause 18: The collapsible catch assembly according to any one of clauses 1-17, wherein the lid is movably connected to the rear wall of the box by a hinge.

Clause 19: The collapsible catch assembly according to any one of clauses 1-18, wherein each of the at least two support poles comprises a lock pin disposed adjacent to an end thereof, each of the lock pins being configured to retain the catch device on the at least two support poles and to be engaged by a tie down device to hold the respective support pole and the catch device in the raised position.

Clause 20: A method of deploying a collapsible catch device, comprising: providing the collapsible catch assembly according to any one of clauses 1-19; disposing the collapsible catch assembly in a ground surface; moving the lid to the open position; pivoting the at two support poles from the folded position to the raised position; and extending the at least two support poles from a collapsed position to an extended position to deploy the catch device to define the catch area.

Clause 21: The method according to clause 20, further comprising: collapsing the at least two support poles from the extended position to the collapsed position; pivoting the at least two support poles from the raised position to the folded position within the hollow interior of the box; and moving the lid to the closed position.

Clause 22: The method according to clause 21, wherein the step of pivoting the at least two support poles from the raised position to the folded position comprises lifting the at least two support poles with respect to bracket assemblies pivotably mounting the at least two support poles to the box.

Clause 23: The method according to clause 21 or clause 22, wherein the step of moving the lid to the open position comprises disengaging a latch disposed on the lid from a flange disposed on an interior of the front wall and the step of moving the lid to the closed position comprises re-engaging the latch with the flange.

Clause 24: The method according to any one of clauses 21-23, wherein the step of moving the lid to the closed position comprises sealing the hollow interior of the box.

Clause 25: The method according to any one of clauses 21-24, wherein the lid is hingedly connected to the rear wall of the box.

Clause 26: The method according to any one of clauses 20-25, further comprising tying down the at least two support poles when the support poles are in the raised and extended positions.

Clause 27: The method according to any one of clauses 20-26, wherein the catch device comprises a net.

Clause 28: The method according to any one of clauses 20-26, wherein the catch device comprises a fabric screen.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
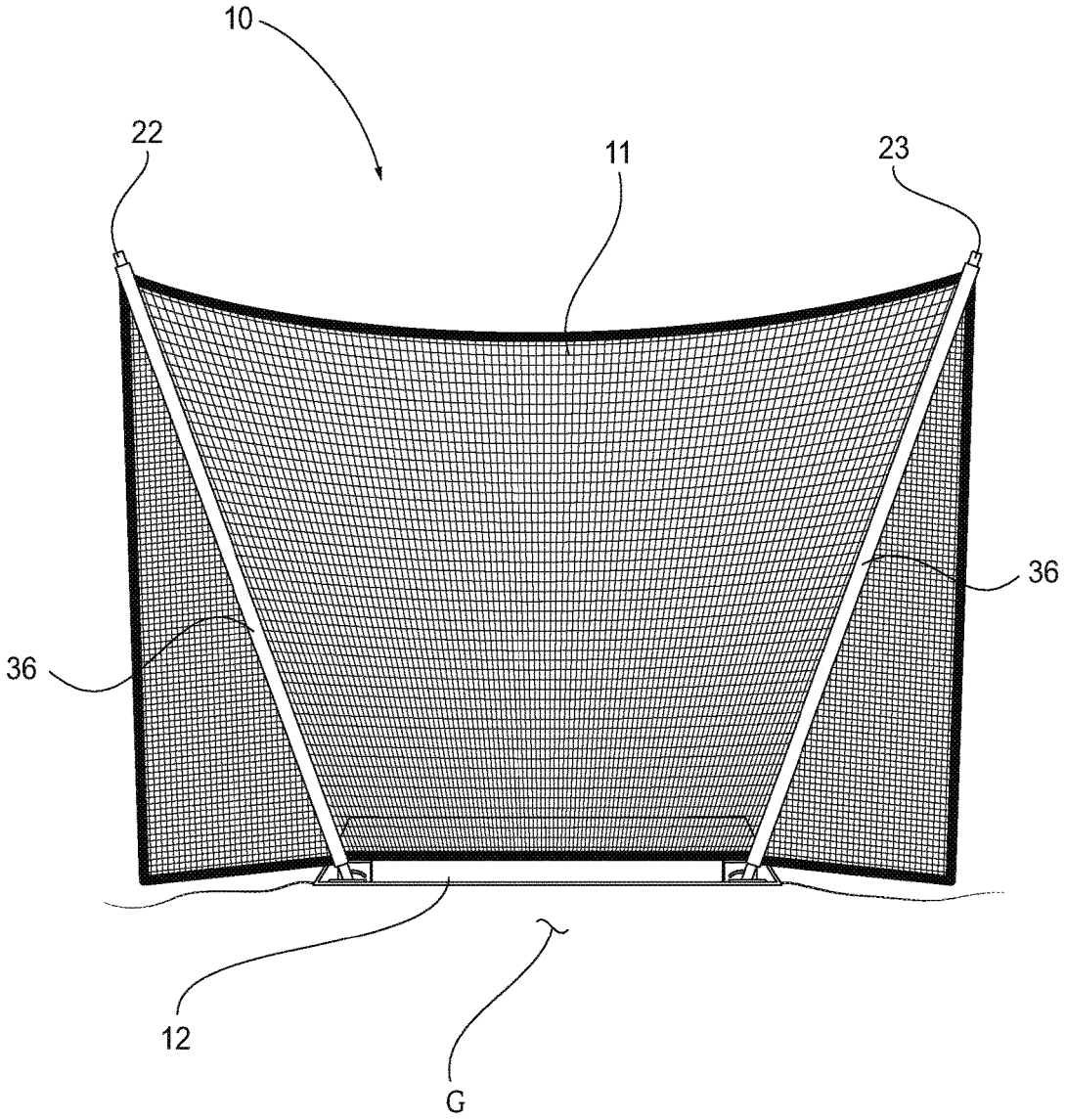
FIG. 1 is a perspective view of a collapsible catch assembly according to a preferred and non-limiting embodiment or aspect of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

Figure 31:
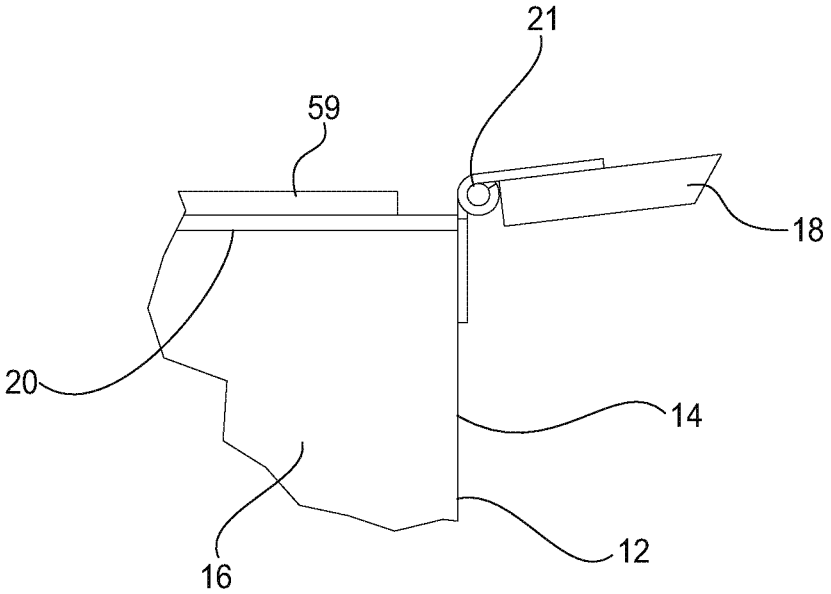
FIG. 31 is a detailed view of area XXXI shown in FIG. 24.

With reference to FIGS. 1-20, a collapsible catch assembly 10 is shown in accordance with one preferred and non-limiting embodiment or aspect of the present disclosure. The assembly 10 includes a box 12 having a front wall 13, a rear wall 14, a left sidewall, 15, a right sidewall 16, a bottom wall 17, and a lid 18. The front wall 13, rear wall 14, left sidewall 15, right sidewall 16, bottom wall 17, and lid 18 collectively define a hollow interior 19 of the box 12. The lid 18 is movably between an open position, shown FIGS. 1-10 and 18-20, for allowing access to the hollow interior 19 of the box 12, and a closed position, shown in FIGS. 11-17, for limiting access to the hollow interior 19. As shown, the lid 18 is movably connected to the rear wall 14 of the box 12 by a hinge 21 to allow the lid 18 to be pivoted between the open position and the closed position. A rim 20 extends along the top edges of the left sidewall 15, the front wall 13, and the right sidewall 16 of the box 12. The rim 20 supports a sealing member 59 disposed thereon, such as the rubber gasket 59 shown in FIG. 31. The sealing member 59 is engaged by the lid 18 of the box 12 when the lid 18 is in the closed position to seal the hollow interior 19 of the box 12. Additionally, the bottom wall 17 may be provided with weep holes (not shown), which will allow moisture to drain from the hollow interior 19 of the box 12.

As shown in FIGS. 3-6, 11-16, and 18, the lid 18 is provided with two latches 37 positioned in the lid 18 near the left and right sides of the lid 18 and aligned along the forward side of the lid 18. The latches 37 can be actuated to rotate to selectively engage and disengage respective flanges 38 in the hollow interior 19 of the box 12 disposed at the corners of the box 12 between the left sidewall 15 and the front wall 13, and between the right sidewall 16 and the front wall 13, as shown in FIGS. 3, 6, 13, 15, 16, 18, and 19. When the lid 18 is in the closed position, the latches 37 can be rotated to engage the respective flanges 38 to lock the lid 18 in the closed position. To open the lid 18, the latches 37 are rotated to disengage from the respective flanges 38 so that the lid 18 can be pivoted upward to expose the hollow interior 19 of the box 12. It is to be appreciated that the latches 37 and flanges 38 maybe of any type or configuration known to be suitable to those having ordinary skill in the art. For instance, the latches 37 may incorporate a lock and be key operated so that only a person having the appropriate key to the latches 37 may open the box 12. Alternatively, the latches 37 may simply incorporate a hand-operated knob or a slot engageable by a screw driver or similar tool to allow the latches 37 to be operated without a key.

According to a particular embodiment or aspect of the present disclosure, the box 12 is configured to be buried in a ground surface G to a level just below the rim 20 and sealing member 59 to allow the lid 18 to be opened and closed easily, as shown in FIG. 1. When opened, the lid 18 can be laid flat on the ground surface G without under strain on the hinge 21.

Figure 2:
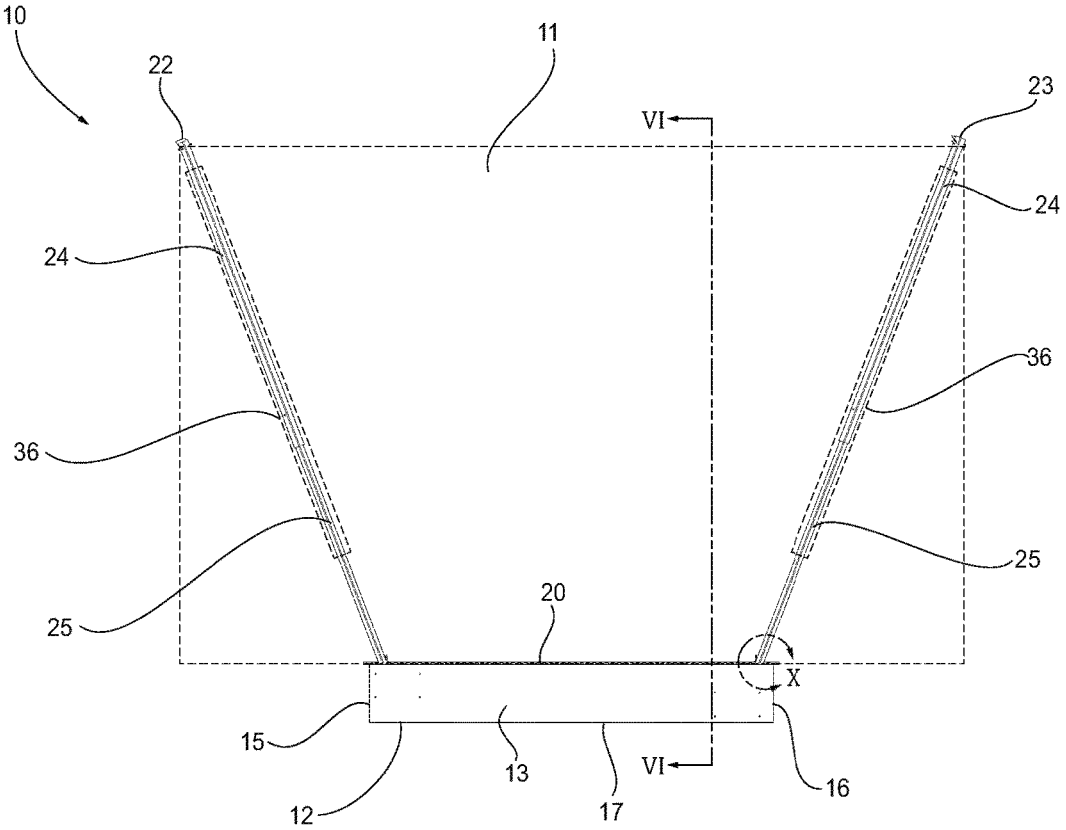
FIG. 2 is a front view of the collapsible catch assembly of FIG. 1.
Figure 3:
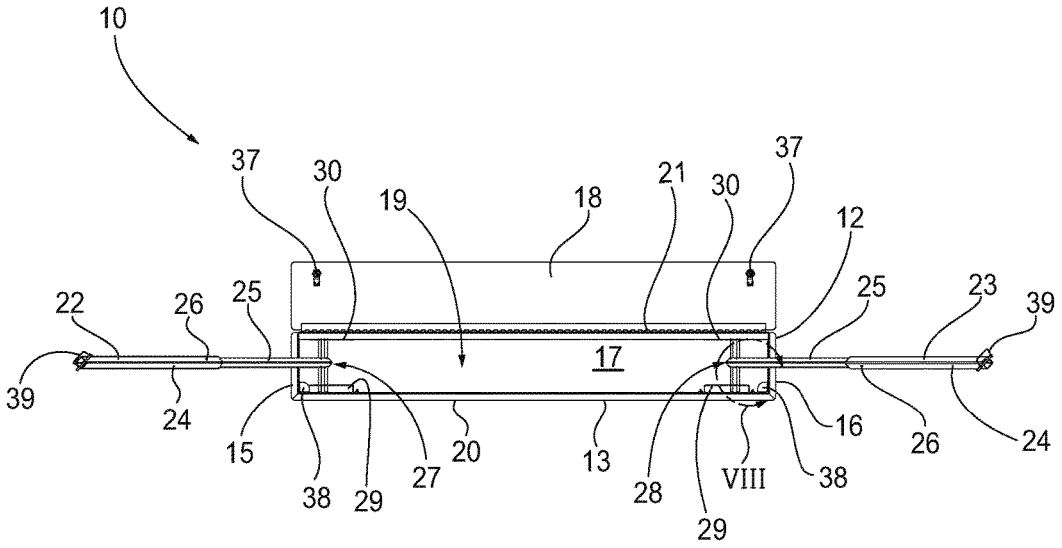
FIG. 3 is a top view of the collapsible catch assembly of FIG. 1.
Figure 4:
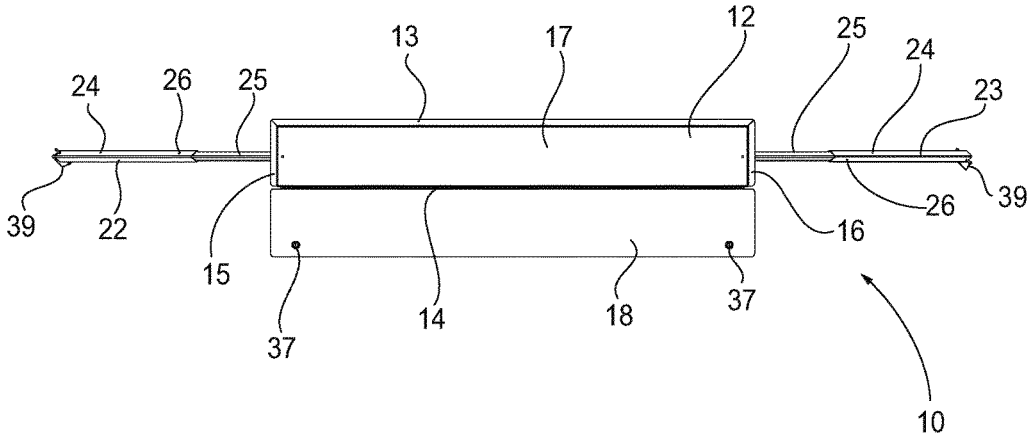
FIG. 4 is a bottom view of the collapsible catch assembly of FIG. 1.
Figure 5:
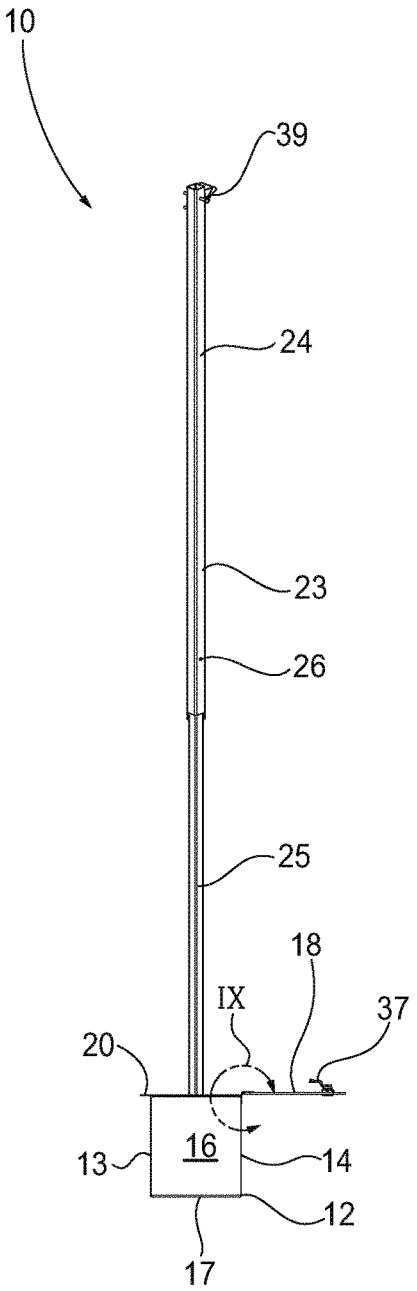
FIG. 5 is a right side view of the collapsible catch assembly of FIG. 1.
Figure 6:
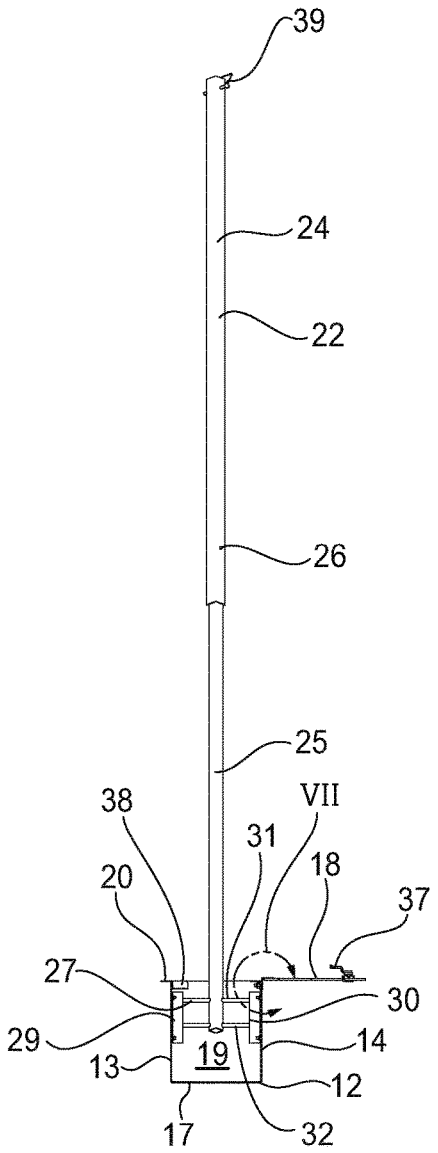
FIG. 6 is a cross-sectional view taken along lines VI-VI shown in FIG. 2.
Figure 7:
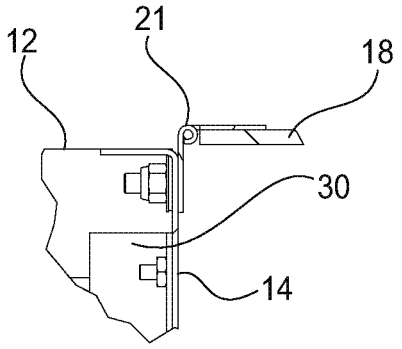
FIG. 7 is a detailed view of area VII shown in FIG. 6.
Figure 8:
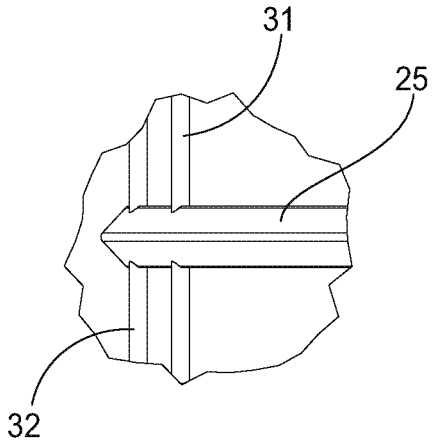
FIG. 8 is a detailed view of area VIII shown in FIG. 3.
Figure 9:
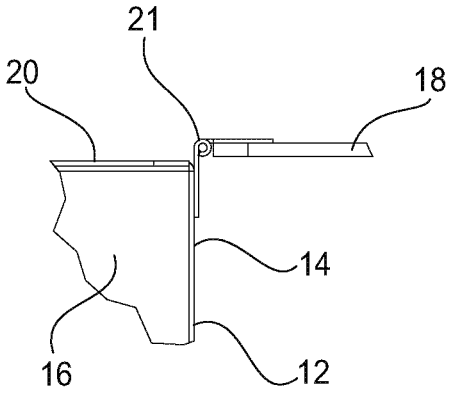
FIG. 9 is a detailed view of area IX shown in FIG. 5.
Figure 10:
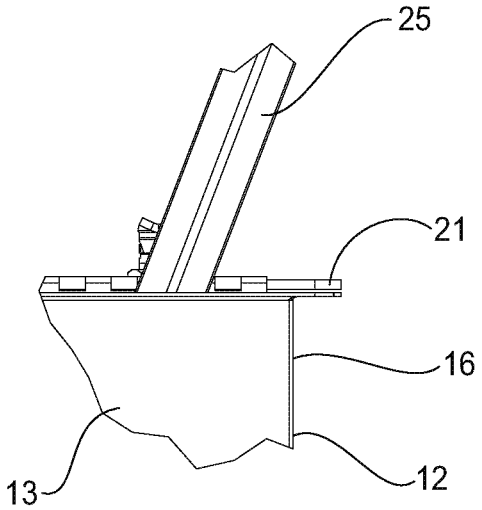
FIG. 10 is a detailed view of area X shown in FIG. 2.
Figure 11:
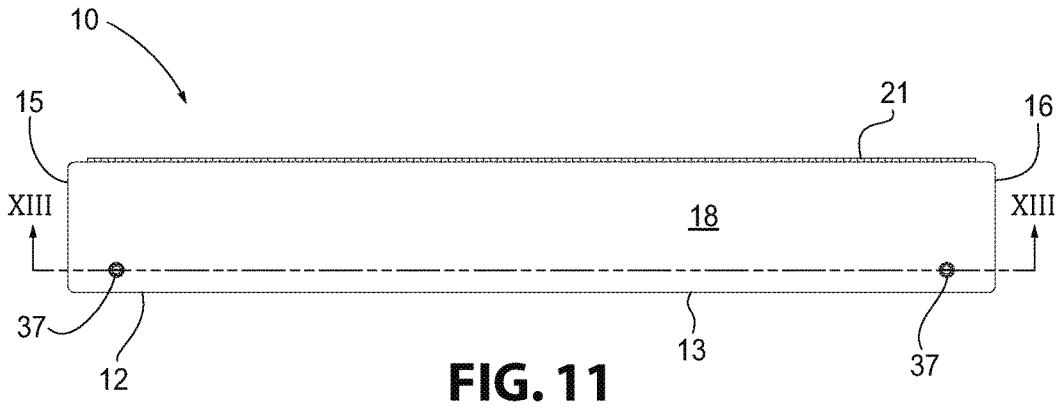
FIG. 11 top view of the collapsible catch assembly of FIG. 1 in a closed condition.
Figure 12:
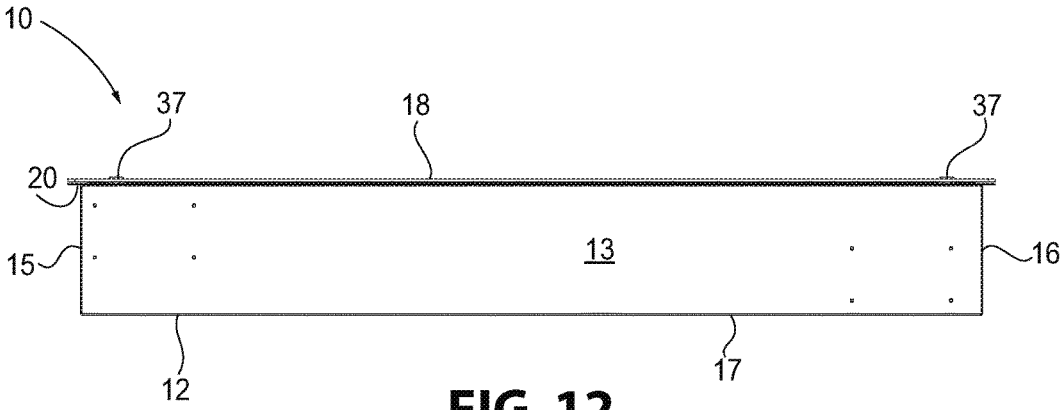
FIG. 12 is a front view of the collapsible catch assembly of FIG. 1 in a closed condition.
Figure 13:
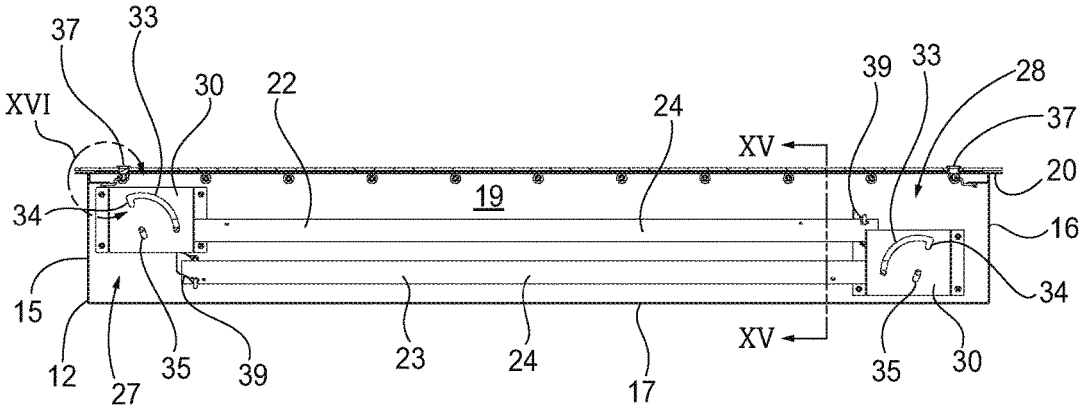
FIG. 13 is a cross-sectional view taken along lines XIII-XIII shown in FIG. 11.
Figure 14:
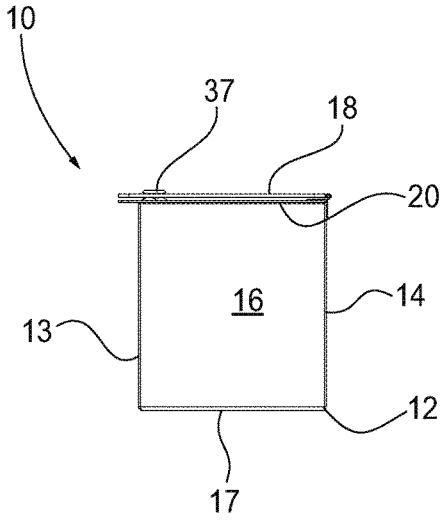
FIG. 14 is a right side view of the collapsible catch assembly of FIG. 1 in a closed condition.
Figure 15:
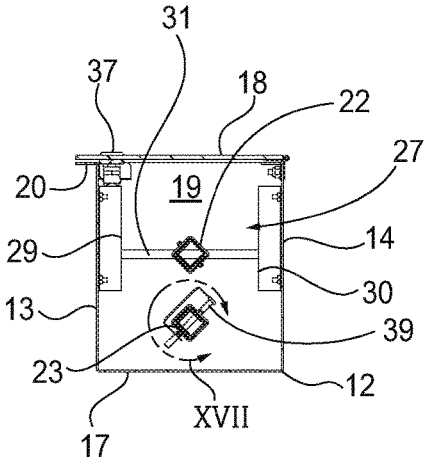
FIG. 15 is a cross-sectional view taken along lines XV-XV shown in FIG. 13.
Figure 16:
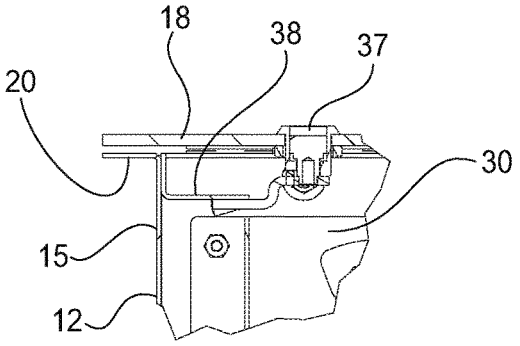
FIG. 16 is a detailed view of area XVI shown in FIG. 13.
Figure 17:
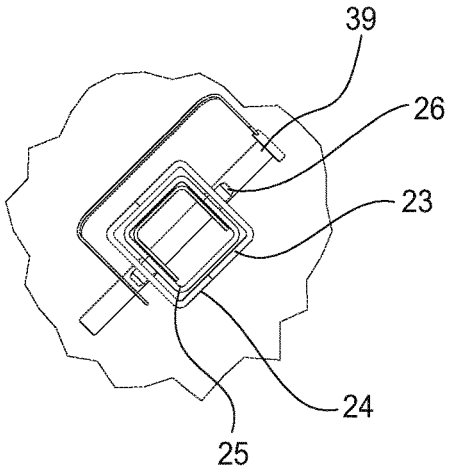
FIG. 17 is a detailed view of area XVII shown in FIG. 15.
Figure 18:
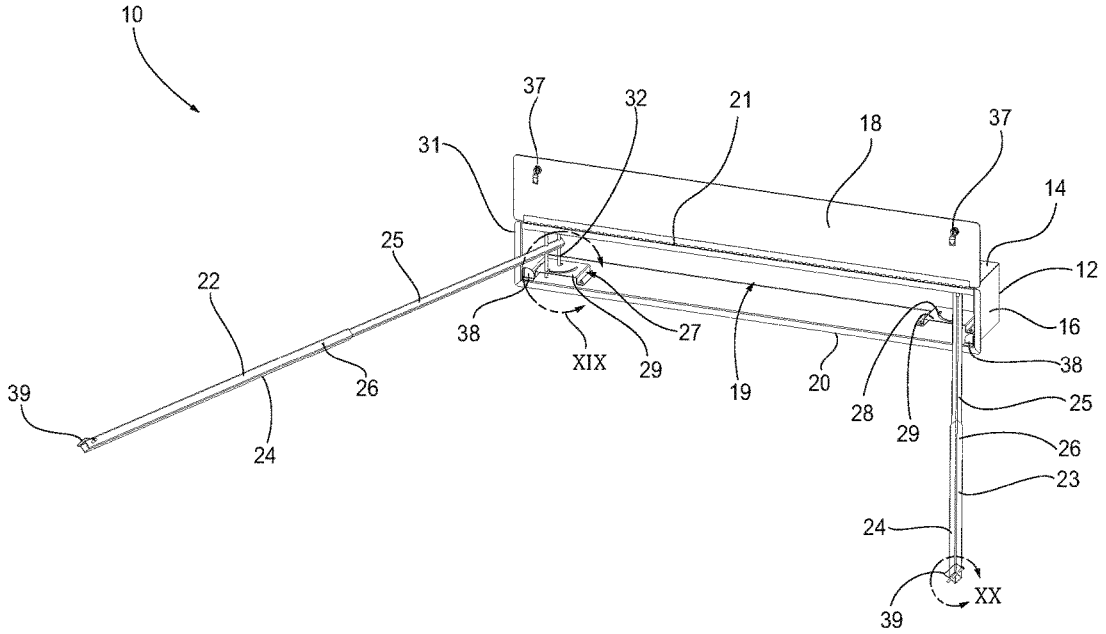
FIG. 18 is an upper perspective view of the collapsible catch assembly of FIG. 1.

With reference to FIGS. 1-6, 8, 10, 13, 15, and 17-20, the assembly 10 also includes at least two support poles 22, 23 pivotably mounted within the hollow interior 19 of the box 12. The at least two support poles 22, 23 are pivotable between a folded position disposed within the hollow interior 19 of the box 12, as shown in FIGS. 13, 15, and 17, and a raised position extending from the hollow interior 19 of the box 12, as shown in FIGS. 1-6, 8, 10, and 18-20. In particular, the assembly 10 includes a left support pole 22 pivotably mounted on the box 12 near the left sidewall 15 and a right support pole 23 pivotably mounted in the box 12 near the right sidewall 16. A catch device 11, shown in FIGS. 1 and 2, is supported on and extends between the two support poles 22, 23. According to one embodiment or aspect, the catch device 11 includes sleeves 36 that slide over the two support poles 22, 23 for securing the catch device 11 on the support poles 22, 23. The support poles 22, 23 and the catch device 11 are collapsible to fit within the hollow interior 19 of the box 12 and extensible to extend out of the hollow interior 19 of the box 12 and define a catch area extending upwardly from the box 12, as shown in FIGS. 1 and 2. It is to be appreciated that the support poles 22, 23 and the catch device 11 are configured to be collapsed and extended while the catch device 11 remains secured on the support poles 22, 23. It is also to be appreciated that the catch device 11 may be of any type known to be suitable to those having ordinary skill in the art for catching, stopping, or impeding the motion of sports balls, such as golf balls, baseballs, softballs, etc. directed at the catch device 11. According to one embodiment or aspect, the catch device 11 is a net, as shown in FIG. 1. According to another embodiment or aspect, the catch device 11 is a fabric screen or curtain.

As shown in FIGS. 1-6, 8, 10, 13, 15, 17-20, 35, and 36, each support pole 22, 23 includes an outer section 24 and an inner section 25 at least partially disposed within the outer section 24. The outer section 24 of each support pole 22, 23 is slidably disposed on the inner section 25 in a telescoping arrangement to provide the support poles 22, 23 with an adjustable length. The outer section 24 is slidable between a collapsed position, shown in FIGS. 13, 15, 17, and 36, and an extended position, as shown in FIGS. 1-6, 8, 10, 18-20, and 35. In this manner, the support poles 22, 23 can be collapsed to fit within the limited space of the hollow interior 19 of the box 12 and extended to define a suitably large catch area with the catch device 11. As shown in FIGS. 3-6, 17, and 18, each of the support poles 22, 23 includes a spring-loaded retaining pin 26 that is configured to retain the outer section 24 in the extended position on the inner section 25. In particular, as shown in FIG. 17, the pin 26 includes protrusions that extend through corresponding holes in the inner section 24 and the outer section 25. The pin 26 is spring loaded so that the pin 26 may be pressed inward to disengage the outer section 24 to allow the outer section 24 to be moved to the collapsed position and automatically extend to engage the outer section 24 when the outer section 24 is moved to the extended position. As shown, the outer section 24 forms the upper portion of the support poles 22, 23 while the inner section 25 forms the lower portion. It is to be appreciated that the arrangement of the outer and inner sections 24, 25 may be reversed.

A wire lock pin 39 is disposed at or adjacent to the end of the outer section 24 of each of the support poles 22, 23. The wire lock pin 39 serves to retain the catch device 11 on each of the support poles 22, 23. Also, the wire lock pins 39 facilitate handling of the support poles 22, 23 and provide attachment points for tie-down lines that help to stretch the catch device 11 and maintain the catch assembly 10 in the raised and extended position.

With reference to FIGS. 3, 6, 8, 13, 15, 18, 19, 35, and 36, the assembly 10 also includes at least two bracket assemblies 27, 28 disposed within the hollow interior 19 of the box 12. Each bracket assembly 27, 28 is configured to pivotably mount a respective one of the support poles 22, 23 in the hollow interior 19 of the box 12. In particular, the assembly 10 includes a left bracket assembly 27 mounted in the hollow interior 19 near the left sidewall 15 of the box 12 for pivotably mounting the left support pole 22 and a right bracket assembly 28 mounted in the hollow interior 19 near the right sidewall 16 of the box 12 for pivotably mounting the right support pole 23. As shown, the right bracket assembly 28 is mounted in the hollow interior 19 lower than the left bracket assembly 27. Accordingly, the support poles 22, 23 can be disposed in the folded position within the hollow interior 19 of the box 12 with the left support pole 22 being stacked over the right support pole 23, as shown in FIGS. 13 and 15. According to one embodiment or aspect, the right support pole 23 is formed to be slightly longer than the left support pole 22 to compensate for the lower position of the right bracket assembly 28 in the hollow interior 19 of the box 12 such that the left support pole 22 and the right support pole 23 extend from the box 12 to the same height. It is to be appreciated that the right bracket assembly 28 may be positioned in the hollow interior 19 of the box 12 higher than the left bracket assembly 27 such that the right support pole 23 is stacked over the left support pole 22 in the folded position.

Figure 19:
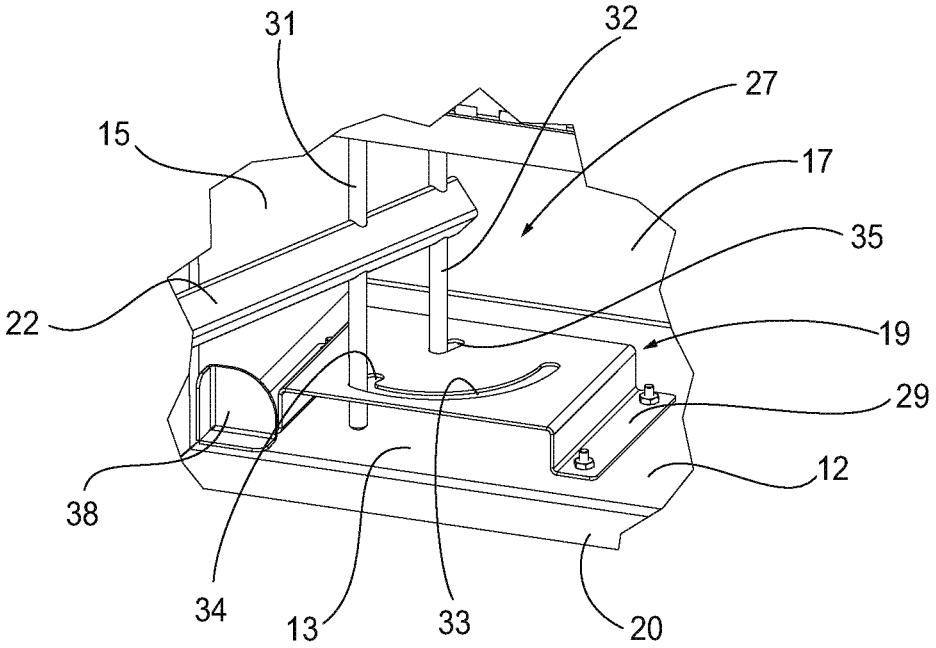
FIG. 19 is a detailed view of area XIX shown in FIG. 18.
Figure 20:
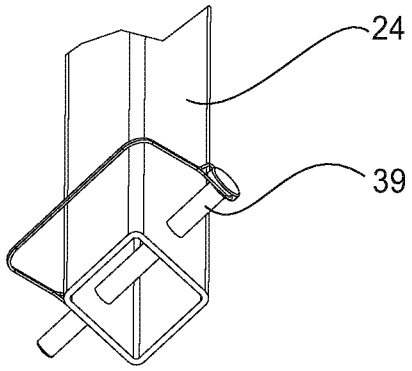
FIG. 20 is a detailed view of area XX shown in FIG. 18.
Figure 21:
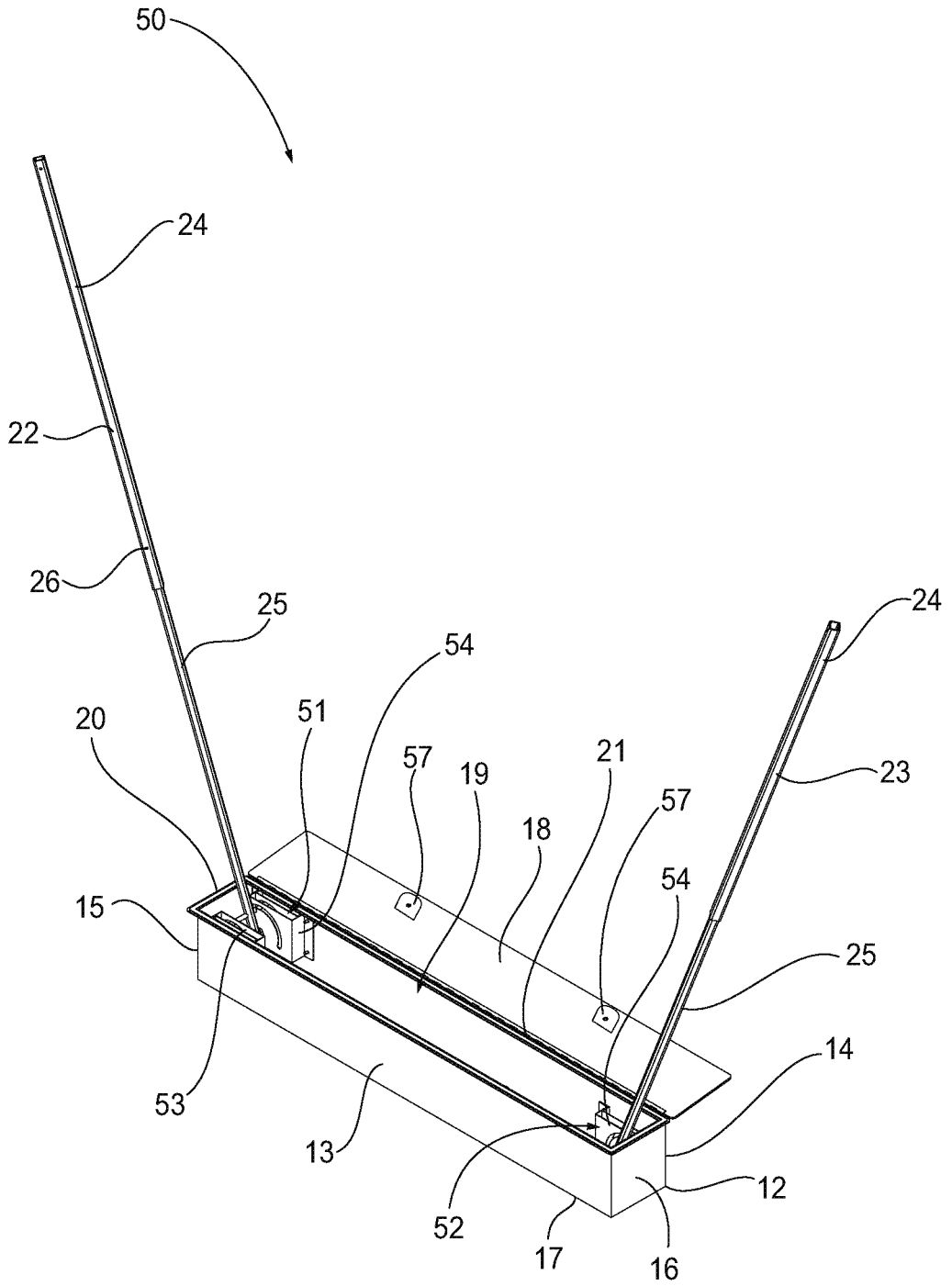
FIG. 21 is a perspective view of a collapsible catch assembly according to another preferred and non-limiting embodiment or aspect of the present disclosure.
Figure 22:
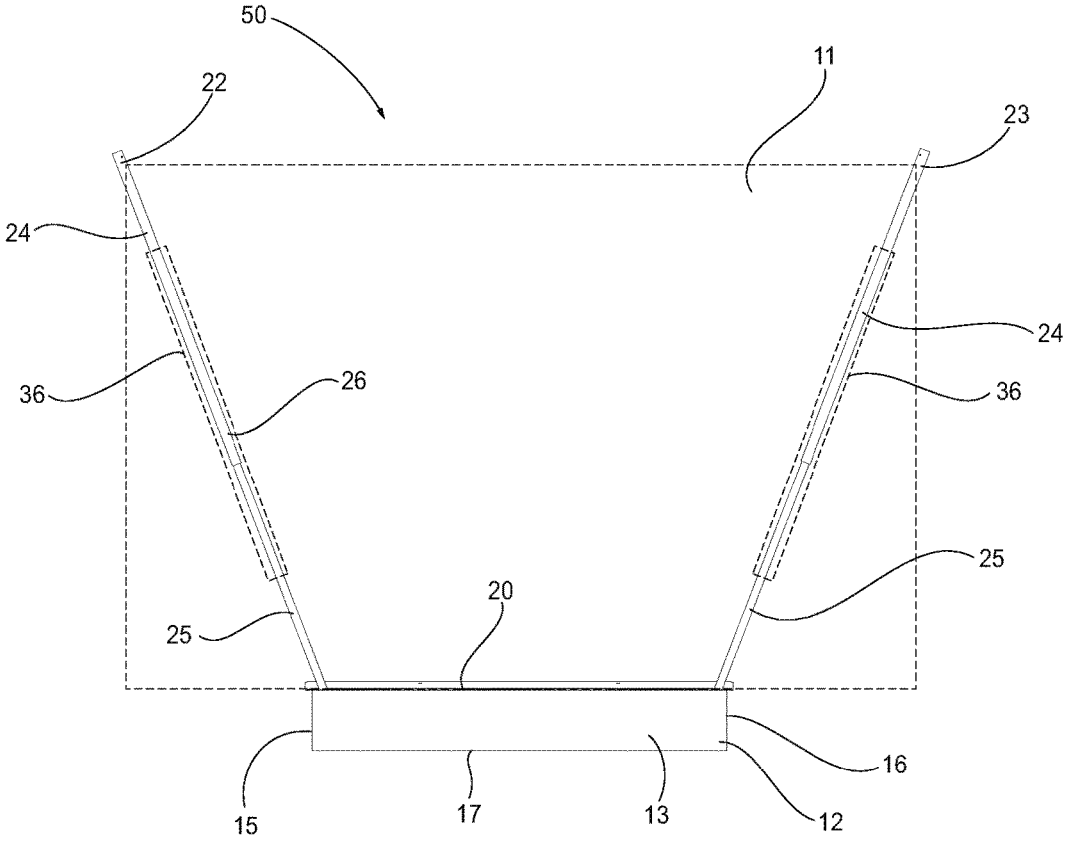
FIG. 22 is a front view of the collapsible catch assembly of FIG. 21.
Figure 23:
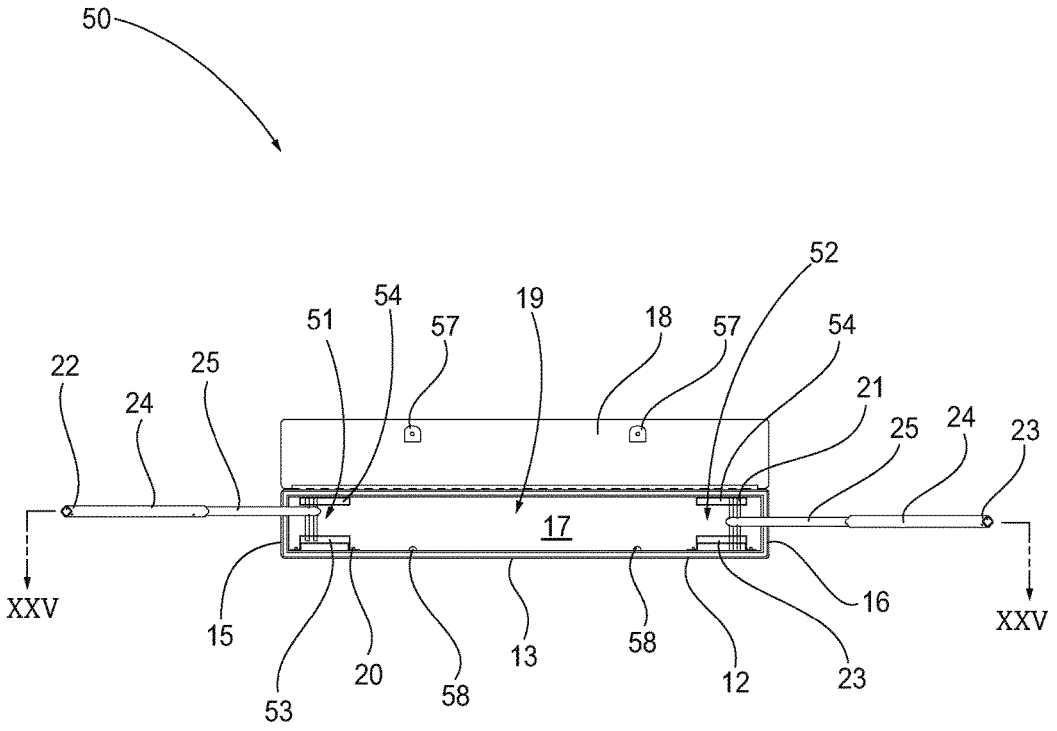
FIG. 23 is a top view of the collapsible catch assembly of FIG. 21.
Figure 24:
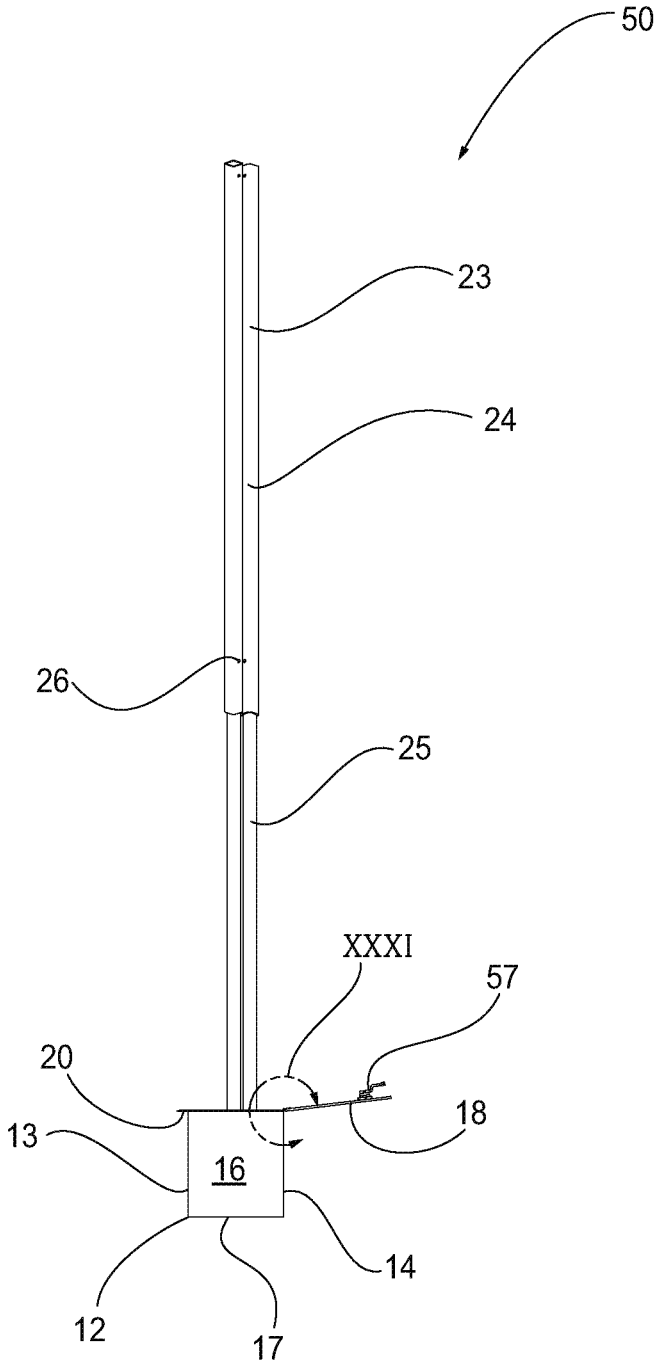
FIG. 24 is a right side view of the collapsible catch assembly of FIG. 21.
Figure 25:
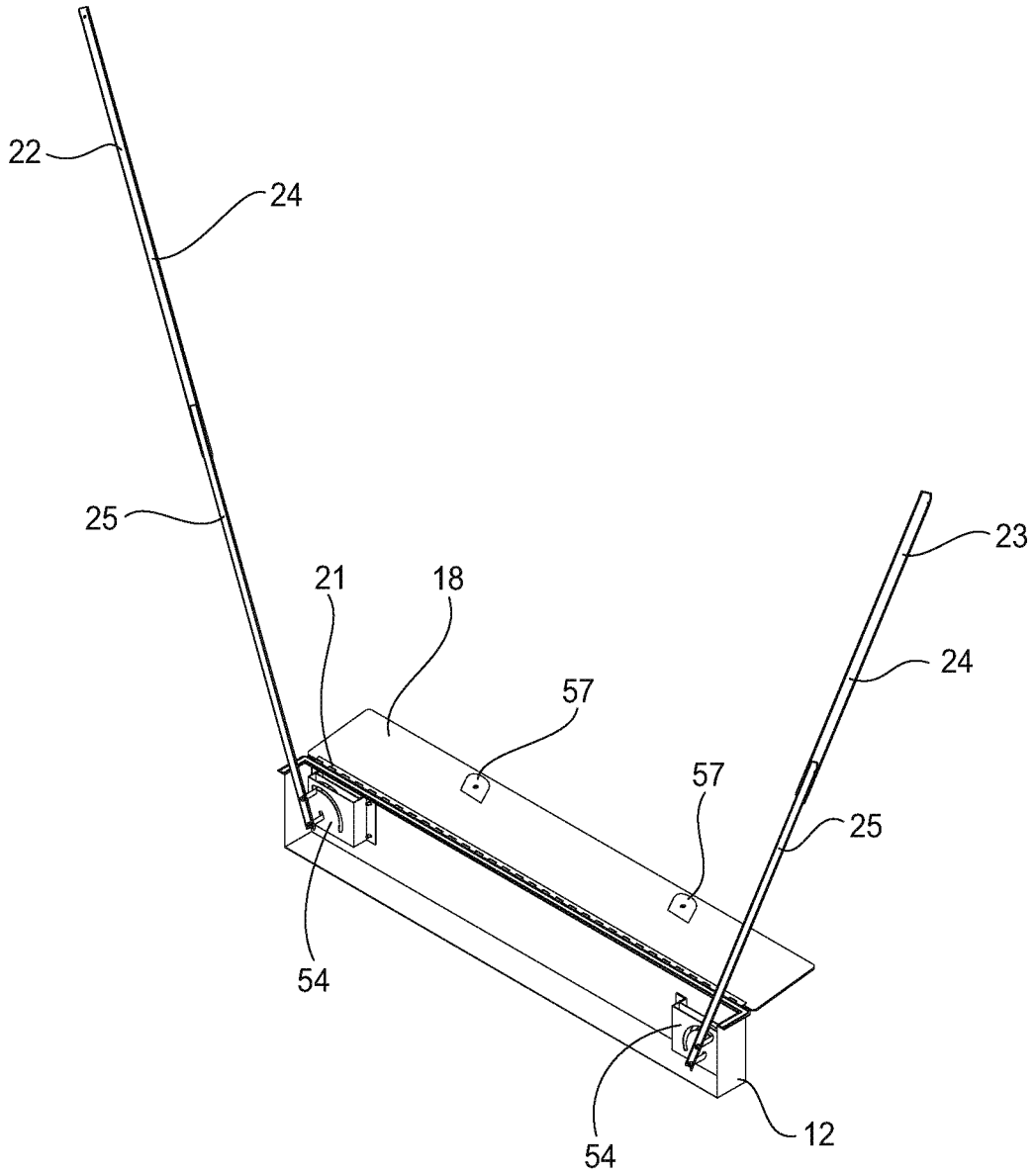
FIG. 25 is a cross-sectional perspective view taken along lines XXV-XXV shown in FIG. 23.
Figure 26:
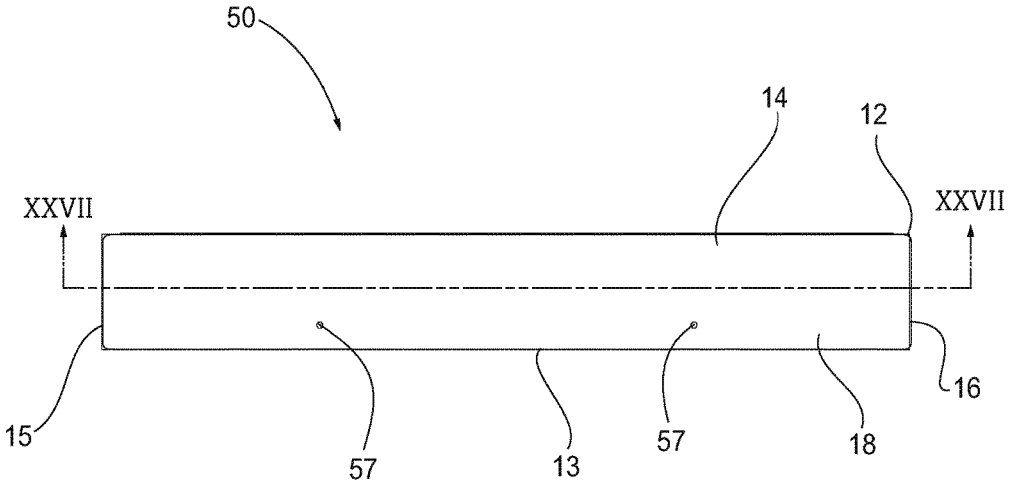
FIG. 26 is a top view of the collapsible catch assembly of FIG. 21 in a closed condition.

Each bracket assembly 27, 28 includes a front bracket 29 mounted on an interior of the front wall 13 of the box 12 and a rear bracket 30 mounted on an interior of the rear wall 14 of the box 12. An upper pin 31 and a lower pin 32 extend between the front bracket 29 and the rear bracket 30 and through the inner section 25 of the respective support pole 22, 23. Each of the front bracket 29 and the rear bracket 30 includes an upper slot 33 and a lower slot 35 defined therein. The respective upper slots 33 and lower slots 35 of the front bracket 29 and the rear bracket 30 are aligned so that the upper pin 31 can be slidably disposed in the upper slots 33 of the front bracket 29 and the rear bracket 30 and the lower pin 32 can be pivotably and slidably disposed in the lower slots 35 of the front bracket 29 and the rear bracket 30. In particular, the upper slots 33 in the front bracket 29 and the rear bracket 30 have an arcuate shape corresponding to the motion of the respective support pole 22, 23 from the folded position to the raised position. The upper slots 33 end in notches 34. When the respective support pole 22, 23 reaches the raised position, the upper pin 31 will become disposed within the notches 34. Accordingly, the notches 34 operate to retain the respective support pole 22, 23 in the raised position. To return the respective support pole 22, 23 to the folded position, the respective support pole 22, 23 must be lifted up so that the upper pin 31 disengages from the notches 34 and returns to a sliding engagement with the arcuate portion of the upper slots 33. The lower slots 35 are suitably shaped to allow the lower pin 32 to move within the lower slots 35 in a range of motion corresponding to the distance needed to lift the upper pin 31 from the notches 34 and to allow the lower pin 32 to pivot therein without significant lateral motion. According to one particular embodiment or aspect of the present disclosure, the lower slots 35 have an oblong circular or oval shape, as shown in FIGS. 13 and 19.

With reference to FIGS. 21-31, a collapsible catch assembly 50 is shown in accordance with another preferred and non-limiting embodiment or aspect of the present disclosure. The collapsible catch assembly 50 is assembled and operated in the same manner as the collapsible catch assembly discussed above with reference to FIGS. 1-20. As such, the reference numbers used in FIGS. 1-20 are also used in FIGS. 21-31 to identify like components. Only specific variations of the collapsible catch assembly 50 from the previously described collapsible catch assembly 10 will be discussed in detail below. It is to be appreciated that the specific details discussed above with respect to the collapsible catch assembly 10 of FIGS. 1-20 are also applicable to the collapsible catch assembly 50 of FIGS. 21-31 except as discussed below.

As shown in FIGS. 21, 23-25, and 28-30, the lid 18 of the box 12 of the collapsible catch assembly 50 is provided with two latches 57 positioned inwardly of the left and right sides of the lid 18 and aligned along the forward side of the lid. The latches 57 are otherwise the same as the latches 37 discussed above with reference to the collapsible catch assembly 10 of FIGS. 1-20. The latches 57 can be actuated to rotate to selectively engage and disengage respective flanges 58 mounted on the interior surface of the front wall 13 in the hollow interior 19 of the box 12. The flanges 58 are mounted on the front wall 13 at positions corresponding to the positions of the latches 57 on the lid 18.

Figure 27:
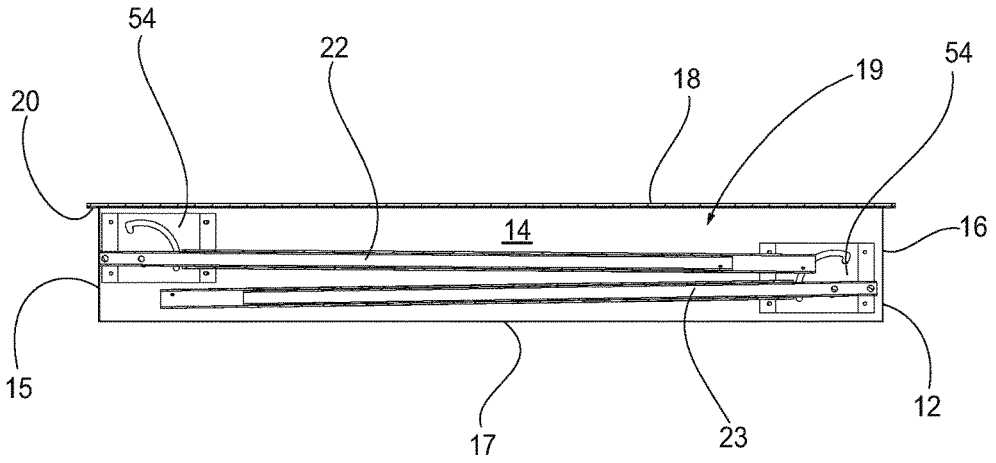
FIG. 27 is a cross-sectional view taken along lines XXVII-XXVII shown in FIG. 26.
Figure 28:
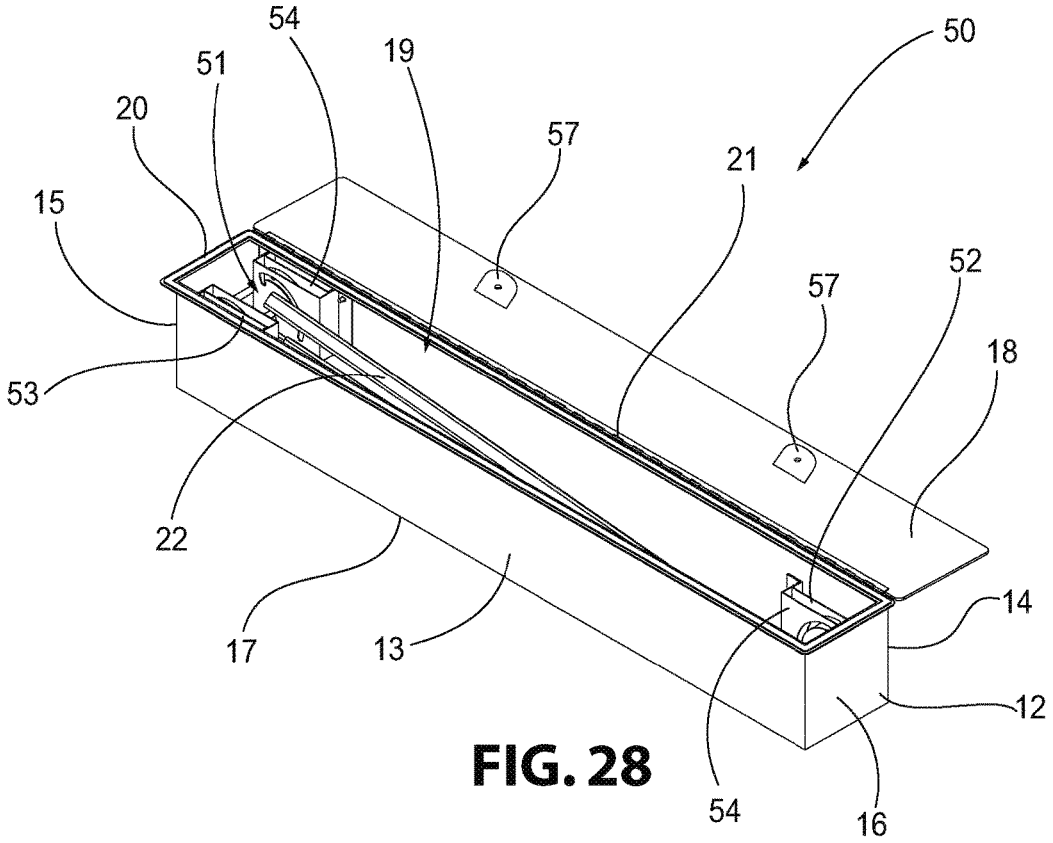
FIG. 28 is a perspective view of the collapsible catch assembly of FIG. 21 in an open and collapsed condition.
Figure 29:
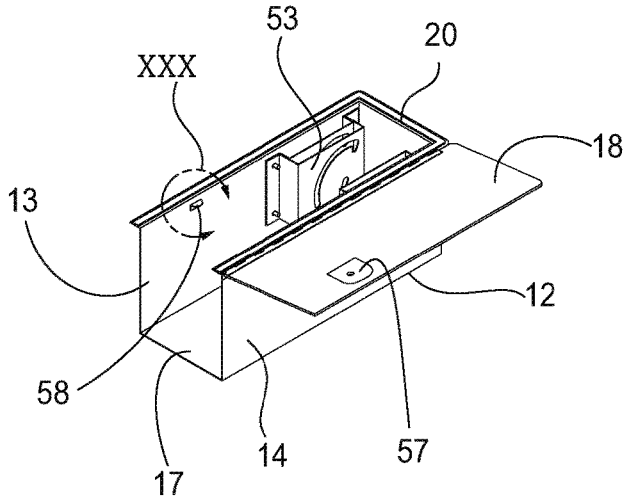
FIG. 29 is a partial perspective view of the collapsible catch assembly of FIG. 21 in an open condition.
Figure 30:
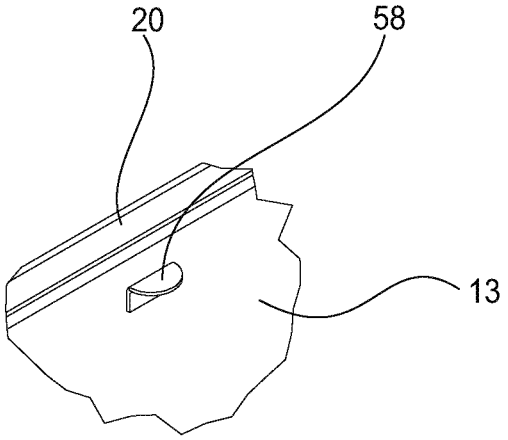
FIG. 30 is a detailed view of area XXX shown in FIG. 29.

As shown in FIGS. 21, 23, 25, and 27-29, the collapsible catch assembly 50 includes a left bracket assembly 51 and a right bracket assembly 52 disposed within the hollow interior 19 of the box 12. Each bracket assembly 51, 52 is configured to pivotably mounted a respective one of the support poles 22, 23 in the hollow interior 19 of the box 12. The left bracket assembly 51 is mounted in the hollow interior 19 near the left sidewall 15 of the box 12 for pivotably mounting the left support pole 22 and the right bracket assembly 52 is mounted in the hollow interior 19 near the right sidewall 16 of the box 12 for pivotably mounting the right support pole 23. As shown, the right bracket assembly 52 is mounted in the hollow interior 19 lower than the left bracket assembly 51. Accordingly, the support poles 22, 23 can be disposed in the folded position within the hollow interior 19 of the box 12 with the left support pole 22 being stacked over the right support pole 23, as shown in FIGS. 27 and 28.

Figure 32:
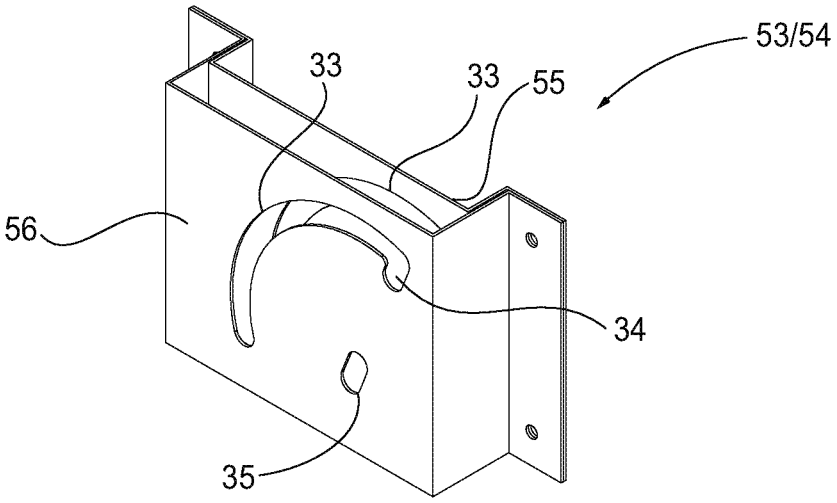
FIG. 32 is a perspective view of a bracket set according to a preferred and non-limiting embodiment of the present disclosure.
Figure 33:
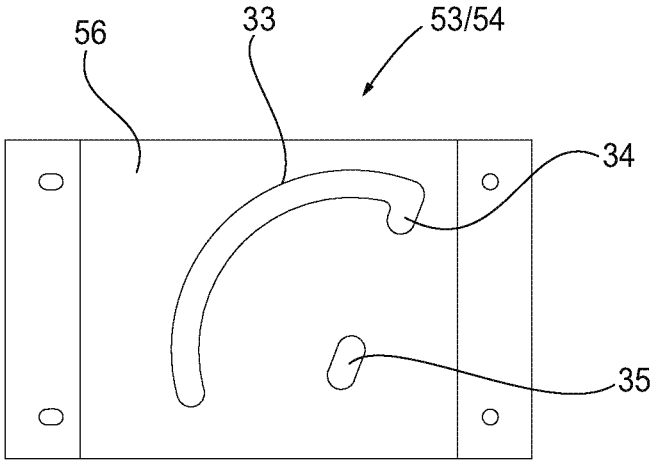
FIG. 33 is a front view of the bracket set of FIG. 32.
Figure 34:
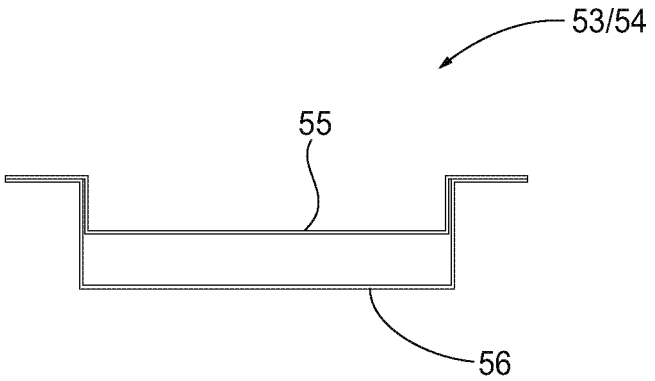
FIG. 34 is a top view of the bracket set of FIG. 32.
Figure 35:
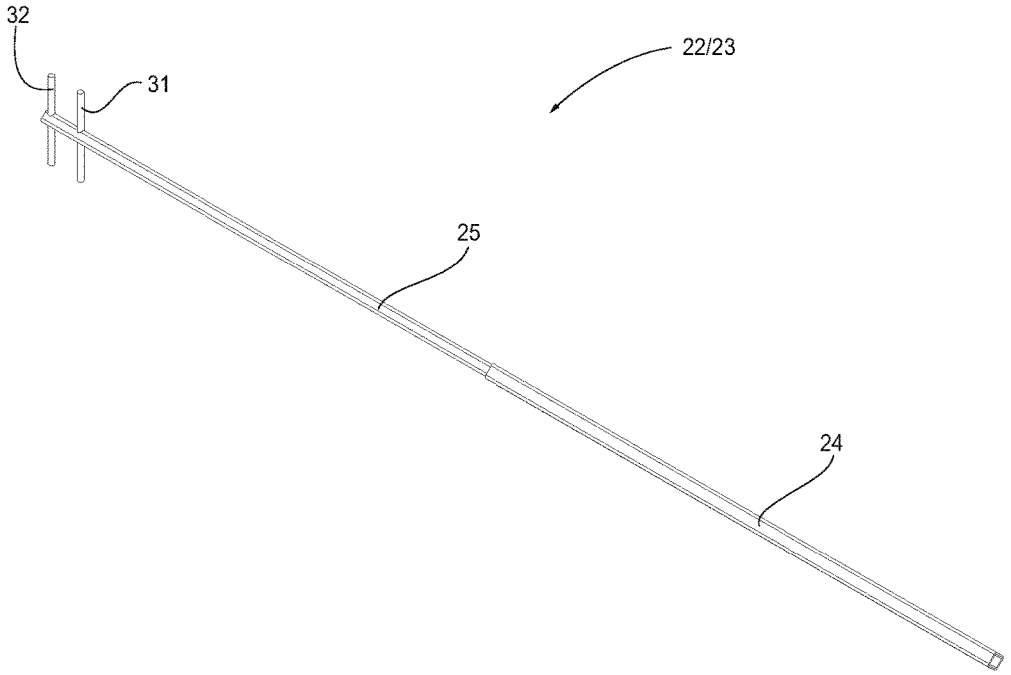
FIG. 35 is a perspective view of a support pole according to a preferred and non-limiting embodiment of the present disclosure in an extended condition.
Figure 36:
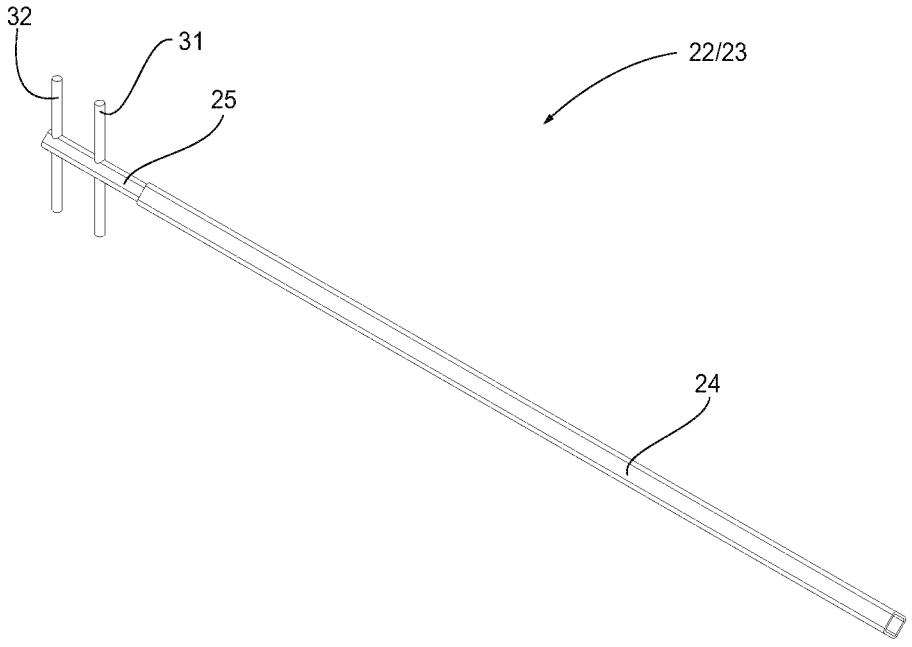
FIG. 36 is a perspective view of the support pole of FIG. 35 in a collapsed condition.

Each bracket assembly 51, 52 includes a front bracket set 53 mounted on the interior of the front wall 13 of the box and a rear bracket set 54 mounted on an interior of the rear wall 14 of the box 12. As shown in FIGS. 32-34, the front bracket set 53 and the rear bracket set 54 each include an inner bracket 55 nested within an outer bracket 56. The upper pin 31 and the lower pin 32 extend between the front bracket set 53 and the rear bracket set 54 and through a respective one of the left support pole 22 and the right support pole 22. Each of the inner bracket 55 and the outer bracket 56 of the front bracket set 53 and each of the inner bracket 55 and the outer bracket 56 of the rear bracket set 54 includes an upper slot 33 and a lower slot 35 defined therein. The upper pin 31 on the respective support pole 22, 23 is slidably disposed in the upper slots 33 of the front bracket set 53 and the rear bracket set 54. The lower pin 32 on the respective support pole 22, 23 is pivotably and slidably disposed in the lower slots 35 of the front bracket set 53 and the rear bracket set 54.

As shown in FIGS. 32-34, the upper slot 33 of each of the inner and outer brackets 55, 56 of the front bracket set 53 and each of the inner and outer brackets 55, 56 of the rear bracket set 54 has an arcuate shape ending in a notch 34. The lower slot 35 of each of the inner and outer brackets 55, 56 of the front bracket set 53 and each of the inner and outer brackets 55, 56 of the rear bracket set 54 has an oblong circular or oval shape. The notch 34 of the upper slot 33 of each of the inner and outer brackets 55, 56 of the front bracket set 53 and each of the inner and outer brackets 55, 56 of the rear bracket set 54 is configured to engage the respective upper pin 31 to retain the respective support pole 22, 23 in the raised position. The upper slots 33 of the inner and outer brackets 55, 56 of the front bracket set 53 are aligned with each other and the lower slots 35 of the inner and outer brackets 55, 56 of the rear bracket set 54 are aligned such that the respective pins 31, 32 may be engaged with the slots 33, 35 in both of the inner and outer brackets 55, 56. Also, the upper slots 33 of the front bracket set 53 and the rear bracket set 54 are aligned and the lower slots 35 of the front bracket set 53 and the rear bracket set 54 are aligned so that the upper pin 31 can be slidably disposed in the upper slots 33 of the front bracket set 53 and the rear bracket set 54 and the lower pin 32 can be pivotably and slidably disposed in the lower slots 35 of the front bracket set 53 and the rear bracket set 54.

In particular, as discussed above with respect to the brackets 29, 30 of the collapsible catch assembly 10 discussed above with reference to FIGS. 1-20, the upper slots 33 have an arcuate shape corresponding to the motion of the respective support pole 22, 23 from the folded position to the raised position. The upper slots 33 end in notches 34. When the respective support pole 22, 23 reaches the raised position, the upper pin 31 will become disposed within the notches 34. Accordingly, the notches 34 operate to retain the respective support pole 22, 23 in the raised position. To return the respective support pole 22, 23 to the folded position, the respective support pole 22, 23 must be lifted up so that the upper pin 31 disengages from the notches 34 and returns to a sliding engagement with the arcuate portion of the upper slots 33. The lower slots 35 are suitably shaped to allow the lower pin 32 to move within the lower slots 35 in a range of motion corresponding to the distance needed to lift the upper pin 31 from the notches 34 and to allow the lower pin 32 to pivot therein without significant lateral motion. The inner and outer nested brackets 55, 56 are provided to each of the front bracket set 53 and the rear bracket set 54 of each of the left and right bracket assemblies 51, 52 to increase the strength and structural rigidity of the bracket assemblies 51, 52.

With reference to FIGS. 1-36, it is to be appreciated that the collapsible catch assemblies 10, 50 may be manufactured from any material and according to any assembly technique known to be suitable to those having ordinary skill in the art. According to one particular embodiment or aspect, the box 12 is constructed from a steel, stainless steel, or aluminum material suitably painted or treated to avoid or limit corrosion of the box 12. The individual brackets 29, 30, 55, 56 and the support poles 22, 23 may be also be formed from similar metal materials. The hinge 21 may be connected to the box 12 and to the lid 18 by welding or by mechanical fasteners, such as bolts or rivets, or by a combination of assembly techniques. Similarly, the individual brackets 29, 30, 55, 56 may be connected to the box 12 by mechanical fasteners, such as bolts or rivets, or by welding. To the extent that mechanical fasteners are used to assemble the components of the collapsible catch assemblies 10, 50, care should be taken to choose fasteners of suitable materials to avoid the creation of a galvanic reaction and resulting corrosion between the fasteners and the components of the assemblies 10, 50. Also, the components of the collapsible catch assembly 10, 50 may be modified from the illustrated embodiments to accommodate variations in construction and the use of different/additional/fewer components than illustrated. For instance, any one of the individual brackets 29, 30, 55, 56 may have cut out portions, such as arched or scallop-shaped cut out portions, that are configured to accommodate the presence of the latches 37, 57 and flanges 38, 58 near the tops of the brackets 29, 30, 55, 56. As discussed above, the catch device 11 may be a net, fabric screen, or curtain made from a suitable fabric material, such as nylon.

With continuing reference to FIGS. 1-36, according to one embodiment or aspect of the present disclosure, a method of deploying a collapsible catch device 11 is provided. The method includes providing the collapsible catch assembly 10, 50 described above; disposing the collapsible catch assembly 10, 50 in a ground surface G; moving the lid 18 to the open position; pivoting the at least two support poles 22, 23 from the folded position to the raised position; and extending the at least two support poles 22, 23 from a collapsed position to an extended position to deploy the catch device 11 to define the catch area. The step of moving the lid 18 to the open position may include disengaging a latch 37, 57 disposed on the lid 18 from a flange 38, 58 disposed on an interior of the front wall 13. The lid 18 is hingedly connected to the rear wall 14 of the box 12. The method may further include tying down the at least two support poles 22, 23 when the support poles 22, 23 are in the raised and extended positions.

The method may further include collapsing the at least two support poles 22, 23 from the extended position to the collapsed position; pivoting the at least two support poles 22, 23 from the raised position to the folded position within the hollow interior 19 of the box 12; and moving the lid 18 to the closed position. The step of pivoting the at least two support poles 22, 23 from the raised position to the folded position may include lifting the at least two support poles 22, 23 with respect to the bracket assemblies 27, 28, 51, 52 pivotably mounting the at least two support poles 22, 23 to the box 12. The step of moving the lid 18 to the closed position may include re-engaging the latch 37, 57 with the flange 38, 58. The step of moving the lid 18 to the closed position may also include sealing the hollow interior 19 of the box 12.

It is to be understood that the invention may assume various alternative variations and step sequences, except where expressly specified to the contrary. It is also to be understood that the specific devices and processes illustrated in the attached drawings, and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that, to the extent possible, one or more features of any embodiment or aspect can be combined with one or more features of any other embodiment or aspect.

The invention claimed is:

1. A collapsible catch assembly comprising:

a box comprising a front wall, a rear wall, a left sidewall, a right sidewall, a bottom wall, and a lid collectively defining a hollow interior, wherein the lid is movable between an open position for allowing access to the hollow interior and a closed position for limiting access to the hollow interior;

at least two support poles pivotably mounted within the hollow interior of the box, the at least two support poles being pivotable between a folded position disposed within the hollow interior of the box and a raised position extending from the hollow interior of the box; and a catch device supported on and extending between the at least two support poles, wherein the at least two support poles and the catch device are collapsible to fit within the hollow interior of the box and extensible to extend out of the hollow interior of the box and define a catch area extending upwardly from the box, wherein the assembly further comprises at least two bracket assemblies, each bracket assembly being configured to pivotably mount a respective one of the at least two support poles in the hollow interior of the box, wherein each bracket assembly comprises: at least one front bracket mounted on an interior of the front wall of the box; at least one rear bracket mounted on an interior of the rear wall of the box; and an upper pin and a lower pin extending between the at least one front bracket and the at least one rear bracket and through a respective one of the at least two support poles, and wherein each of the at least one front bracket and the at least one rear bracket includes an upper slot and a lower slot defined therein, the upper pin is slidably disposed in the upper slots of the at least one front bracket and the at least one rear bracket, and the lower pin is pivotably and slidably disposed in the lower slots of the at least one front bracket and the at least one rear bracket.

2. The collapsible catch assembly according to claim 1, wherein each of the at least two support poles comprises an outer section and an inner section at least partially disposed within the outer section, the outer section being slidably disposed on the inner section in a telescoping arrangement between a collapsed position and an extended position such that a length of the support pole is adjustable.

3. The collapsible catch assembly according to claim 2, wherein each of the at least two support poles comprises a retaining pin configured to retain the outer section in the extended position.

4. The collapsible catch assembly according to claim 1, wherein the upper slot of each of the at least one front bracket and the at least one rear bracket has an arcuate shape ending in a notch, the lower slot of each of the at least one front bracket and the at least one rear bracket has an oblong circular shape, and the notch of the upper slot of each of the at least one front bracket and the at least one rear bracket is configured to engage the upper pin to retain the respective support pole in the raised position.

5. The collapsible catch assembly according to claim 4, wherein the upper slots of the at least one front bracket and the at least one rear bracket are aligned and the lower slots of the at least one front bracket and the at least one rear bracket are aligned.

6. The collapsible catch assembly according to claim 1, wherein:

the at least one front bracket comprises a front bracket set mounted on the interior of the front wall of the box, the front bracket set comprising an inner bracket nested within an outer bracket;

the at least one rear bracket comprises a rear bracket set mounted on the interior of the rear wall of the box, the rear bracket set comprising an inner bracket nested within an outer bracket; and each of the inner bracket and the outer bracket of the front bracket set and each of the inner bracket and the outer bracket of the rear bracket set includes an upper slot and a lower slot defined therein, the upper pin is slidably disposed in the upper slots of the front bracket set and the rear bracket set, and the lower pin is pivotably and slidably disposed in the lower slots of the front bracket set and the rear bracket set.

7. The collapsible catch assembly according to claim 6, wherein the upper slot of each of the inner and outer brackets of the front bracket set and each of the inner and outer brackets of the rear bracket set has an arcuate shape ending in a notch, the lower slot of each of the inner and outer brackets of the front bracket set and each of the inner and outer brackets of the rear bracket set has an oblong circular shape, and the notch of the upper slot of each of the inner and outer brackets of the front bracket set and each of the inner and outer brackets of the rear bracket set is configured to engage the upper pin to retain the respective support pole in the raised position.

8. The collapsible catch assembly according to claim 7, wherein the upper slots of the inner and outer brackets of the front bracket set are aligned and the lower slots of the inner and outer brackets of the rear bracket set are aligned.

9. The collapsible catch assembly according to claim 8, wherein the upper slots of the front bracket set and the rear bracket set are aligned and the lower slots of the front bracket set and the rear bracket set are aligned.

10. The collapsible catch assembly according to claim 1, wherein the at least two bracket assemblies are vertically spaced with respect to each other such that the at least two support poles are vertically stacked within the hollow interior of the box in the folded position.

11. The collapsible catch assembly according to claim 1, wherein the catch device comprises a net.

12. The collapsible catch assembly according to claim 1, wherein the catch device comprises a fabric screen.

13. The collapsible catch assembly according to claim 1, wherein the catch device comprises sleeves configured to be placed over the at least two support poles to connect the catch device to the at least two support poles.

14. The collapsible catch assembly according to claim 1, further comprising at least one latch disposed on the lid and at least one flange disposed on an interior of the front wall of the box, wherein the at least one latch is configured to engage the at least one flange to retain the lid in the closed position.

15. The collapsible catch assembly according to claim 1, wherein the box comprises a rim extending around a top of the right sidewall, a top of the front wall, and a top of the left sidewall and a sealing member disposed on the rim, and wherein the sealing member is configured to be engaged by the lid when the lid is in the closed position to seal the hollow interior of the box.

16. The collapsible catch assembly according to claim 1, wherein the lid is movably connected to the rear wall of the box by a hinge.

17. The collapsible catch assembly according to claim 1, wherein each of the at least two support poles comprises a lock pin disposed adjacent to an end thereof, each of the lock pins being configured to retain the catch device on the at least two support poles and to be engaged by a tie down device to hold the respective support pole and the catch device in the raised position.

18. A method of deploying a collapsible catch device, comprising:

providing the collapsible catch assembly according to claim 1;

disposing the collapsible catch assembly in a ground surface;

moving the lid to the open position;

pivoting the at two support poles from the folded position to the raised position; and extending the at least two support poles from a collapsed position to an extended position to deploy the catch device to define the catch area.

19. The method according to claim 18, further comprising:

collapsing the at least two support poles from the extended position to the collapsed position;

pivoting the at least two support poles from the raised position to the folded position within the hollow interior of the box; and moving the lid to the closed position.

20. The method according to claim 19, wherein the step of pivoting the at least two support poles from the raised position to the folded position comprises lifting the at least two support poles with respect to bracket assemblies pivotably mounting the at least two support poles to the box.

21. The method according to claim 19, wherein the step of moving the lid to the open position comprises disengaging a latch disposed on the lid from a flange disposed on an interior of the front wall and the step of moving the lid to the closed position comprises re-engaging the latch with the flange.

22. The method according to claim 19, wherein the step of moving the lid to the closed position comprises sealing the hollow interior of the box.

23. The method according to claim 19, wherein the lid is hingedly connected to the rear wall of the box.

24. The method according to claim 18, further comprising tying down the at least two support poles when the support poles are in the raised and extended positions.

25. The method according to claim 18, wherein the catch device comprises a net.

26. The method according to claim 18, wherein the catch device comprises a fabric screen.

* * * * *